US010196718B2

(12) United States Patent
Fukuzawa et al.

(10) Patent No.: US 10,196,718 B2
(45) Date of Patent: Feb. 5, 2019

(54) STEEL STRIP FOR CUTLERY

(71) Applicant: HITACHI METALS, LTD., Tokyo (JP)

(72) Inventors: Norihide Fukuzawa, Yasugi (JP); Tomonori Ueno, Yasugi (JP); Laura Ming Xu, South Boston, MA (US); Charles Samuel White, South Boston, MA (US)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 14/736,636

(22) Filed: Jun. 11, 2015

(65) Prior Publication Data

US 2016/0362770 A1 Dec. 15, 2016

(51) Int. Cl.

| | |
|---|---|
| ***C22C 38/22*** | (2006.01) |
| ***C22C 38/04*** | (2006.01) |
| ***C22C 38/02*** | (2006.01) |
| ***C21D 6/04*** | (2006.01) |
| ***C21D 9/18*** | (2006.01) |
| ***C21D 1/25*** | (2006.01) |

(52) U.S. Cl.

CPC ..... *C22C 38/22* (2013.01); *C21D 1/25* (2013.01); *C21D 6/04* (2013.01); *C21D 9/18* (2013.01); *C22C 38/02* (2013.01); *C22C 38/04* (2013.01); *C21D 2211/004* (2013.01); *C21D 2211/008* (2013.01)

(58) Field of Classification Search

CPC ..... C22C 38/22; C21D 9/18; D21D 1/25

See application file for complete search history.

(56) References Cited

U.S. PATENT DOCUMENTS 3,595,643 A * 7/1971 Boyce ..... B21D 53/645 420/37
4,180,420 A * 12/1979 Sastri ..... C22C 38/22 148/325
5,275,672 A * 1/1994 Althaus ..... C21D 6/04 148/325
5,534,081 A * 7/1996 Takagi ..... C21D 6/002 148/325

(Continued)

FOREIGN PATENT DOCUMENTS

EP 0 779 374 A1 6/1997
EP 1 391 528 A1 2/2004

(Continued)

OTHER PUBLICATIONS

Chinn, Richard E.. (2002). Ceramography—Preparation and Analysis of Ceramic Microstructures—9.5.3 Diamond Pyramid Hardness. ASM International.*

(Continued)

*Primary Examiner* — Colleen P Dunn
*Assistant Examiner* — Jeremy C Jones
(74) *Attorney, Agent, or Firm* — Myers Bigel, P.A.

(57) ABSTRACT

The present invention provides a steel strip for cutlery, which has a composition containing, in mass %, 0.45 to 0.55% of C, 0.2 to 1.0% of Si, 0.2 to 1.0% of Mn, and 12 to 14% of Cr, and further contains Mo, with the balance made up of Fe and unavoidable impurities, in which Mo is contained in an amount of 2.1 to 2.8%, and the amount of formed $M_3C$ deposited by tempering is decreased to improve bending workability.

4 Claims, 5 Drawing Sheets

(56) References Cited

U.S. PATENT DOCUMENTS

| | | | | |
|---|---|---|---|---|
| 5,714,114 | A * | 2/1998 | Uehara | C22C 38/20 148/325 |
| 5,861,068 | A | 1/1999 | Hasegawa et al. | |
| 6,210,806 | B1 * | 4/2001 | Hidaka | C21D 6/002 428/469 |
| 6,235,237 | B1 * | 5/2001 | Osing | C21D 1/25 420/67 |
| 6,797,031 | B1 * | 9/2004 | Engstrom | B22F 5/12 148/325 |
| 2004/0040631 | A1 * | 3/2004 | Takahashi | C21D 8/065 148/226 |
| 2004/0096351 | A1 | 5/2004 | Suzuki et al. | |
| 2006/0000526 | A1 * | 1/2006 | Yoshiyama | B23K 26/0846 148/325 |
| 2007/0000580 | A1 * | 1/2007 | Millward | C21D 1/18 148/542 |
| 2007/0274855 | A1 * | 11/2007 | Nilsson | C22C 38/001 420/38 |

FOREIGN PATENT DOCUMENTS

| | | | |
|---|---|---|---|
| JP | 05-117805 | | 5/1993 |
| JP | 10085803 | A * | 4/1998 |
| JP | 2001049399 | A * | 2/2001 |
| JP | 2007-224405 | | 9/2007 |
| JP | 2009235466 | A * | 10/2009 |
| WO | WO 2005/093112 | A1 | 10/2005 |
| WO | WO 2012/006043 | A1 | 1/2012 |
| WO | WO 2014/162865 | A1 | 10/2014 |
| WO | WO 2016/199932 | A1 | 12/2016 |

OTHER PUBLICATIONS

Sandvik "Stainless chromium steel for razor blades" *Product Brochure* (6 pages) (2002).

International Preliminary Report on Patentability corresponding to International Patent Application No. PCT/JP2016/067467 (15 pages) (dated Sep. 6, 2017).

Metal Supermarkets "Difference Between Annealing and Tempering" www.metalsupermarkets.com/category/processes (2 pages) (posted May 9, 2016).

International Search Report and the Written Opinion of the International Searching Authority corresponding to International Patent Application No. PCT/JP2016/067467 (11 pages) (dated Sep. 7, 2016).

* cited by examiner

No.A 200nm

No.C 200nm

STEEL STRIP FOR CUTLERY

FIELD AND BACKGROUND OF THE INVENTION

The present invention relates to a steel strip for cutlery.

At present, martensitic stainless steel, which is widely and generally used for forming cutlery, is given a hardness required as cutlery by a heat treatment of quenching and tempering. Particularly, a high-carbon martensitic stainless steel strip material containing Cr in an amount of about 13% by mass is most commonly used as a material of cutlery.

Heretofore, for this material of cutlery, a variety of proposals have been made. Among these, particularly, a proposal in which Mo is contained for the purpose of achieving both corrosion resistance and high hardness has been made. For example, JP-A-5-117805 discloses an invention directed to a steel alloy containing, in mass %, 0.45 to 0.55% of C, 0.4 to 1.0% of Si, 0.5 to 1.0% of Mn, 12 to 14% of Cr, and 1.0 to 1.6% of Mo, with the balance made up of Fe and unavoidable impurities as a martensitic stainless steel alloy for cutlery having both high corrosion resistance and high hardness.

On the other hand, WO 2012/006043 reports that a bending process is applied to a steel strip for cutlery, and also reports a problem that the cutlery is cracked or fractured during the bending process.

However, current situation is that as for such a bending process, an attempt to obtain favorable bending workability by adjusting the alloy composition has not been made.

SUMMARY OF THE INVENTION

An object of the present invention is to provide a martensitic stainless steel strip which has both hardness required for cutlery and bending workability.

The present inventors focused on the fact that when the bending process is performed on a steel stip in a state after performing quenching and tempering, cracks are formed on a outer circumferential side of a bending portion first, then formed cracks extend in the thickness direction, and finally the steel strip is broken. Accordingly, the present inventors made studies by focusing on a relationship between the state of the cracks formed on the surface thereof and the metal structure of the steel strip after a heat treatment of quenching and tempering.

As a result, they found that in the steel strip for cutlery after the heat treatment of quenching and tempering, the amount of formed $M_3C$ deposited on a crystal grain boundary by tempering has an effect on the formation of cracks in the bending process. Further, they found that the bending workability of the material after quenching and tempering can be improved by modifying the composition so as to decrease the amount of $M_3C$ at the crystal grain boundary, and thus achieved the invention.

That is, the present invention is directed to a steel strip for cutlery, which has a composition containing, in mass %, 0.45 to 0.55% of C, 0.4 to 1.0% of Si, 0.5 to 1.0% of Mn, and 12 to 14% of Cr, and further contains Mo, with the balance made up of Fe and unavoidable impurities, wherein Mo is contained in an amount of 2.1 to 2.8%.

The steel strip for cutlery of the invention can have sufficient hardness after quenching and tempering. In addition, the problem that a steel strip is cracked or broken during a bending process can be solved.

DESCRIPTION OF THE PREFERRED EMBODIMENTS

Figure 1:
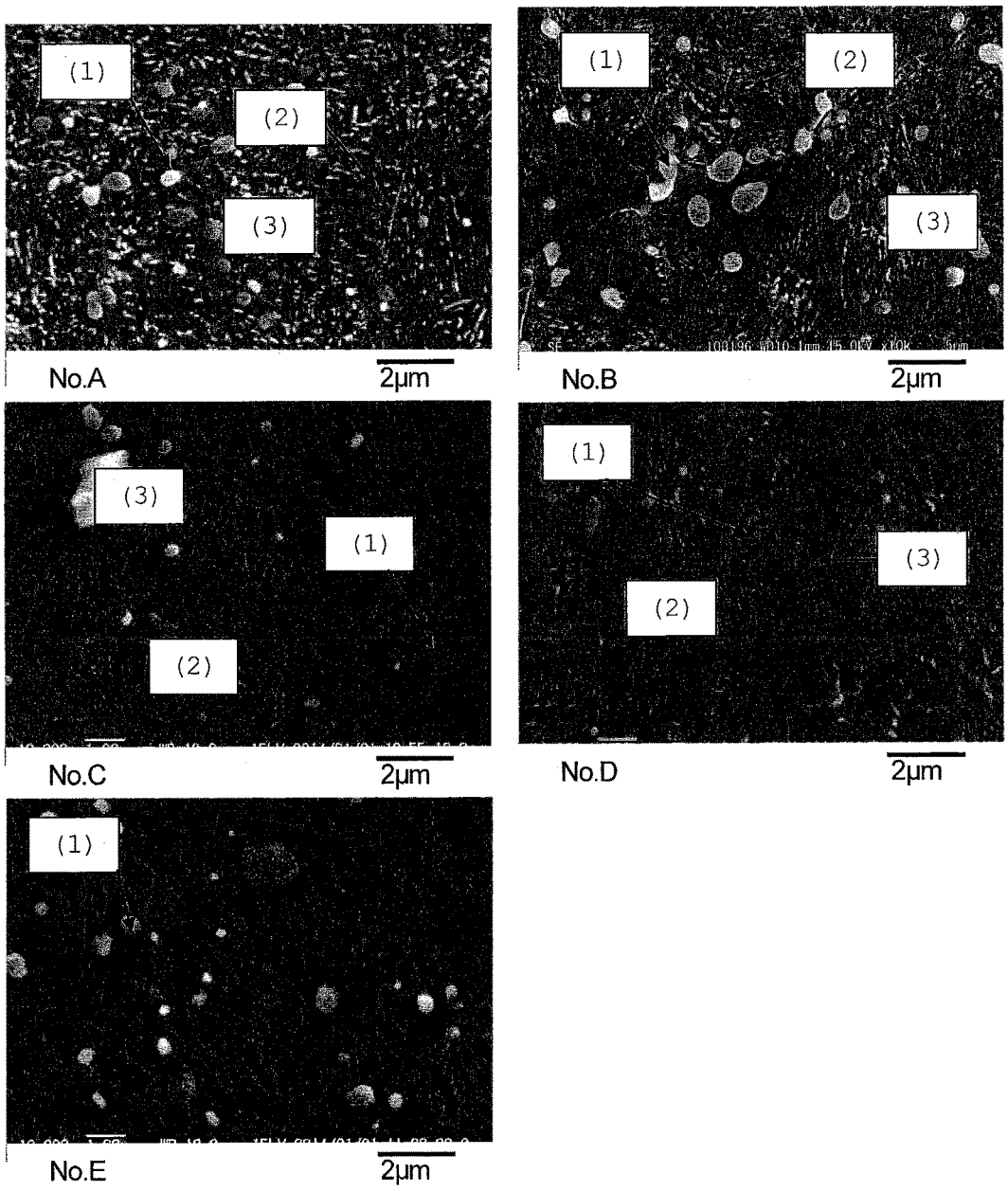
FIG. 1 is electron micrographs showing the metal structure of a steel strip for cutlery.

The present invention now will be described more fully hereinafter in which embodiments of the invention are provided with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art.

The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. Unless otherwise defined, all technical and scientific terms used herein have the same meaning as commonly understood by one of ordinary skill in the art to which this invention belongs. All references cited are incorporated herein by reference in their entirety.

An alloy composition which imparts basic properties to a steel strip for cutlery specified in the present invention will be described. Incidentally, the content of each element is expressed in mass %.

C: 0.45 to 0.55%

The reason why the content of C is set to 0.45 to 0.55% is to achieve a sufficient hardness as cutlery and also to suppress the crystallization of eutectic carbides during casting or solidification to the minimum. If the content of C is less than 0.45%, a sufficient hardness as cutlery cannot be obtained. On the other hand, if the content of C exceeds 0.55%, the amount of crystallized eutectic carbides is increased depending on the balance with the amount of Cr to cause a chip in the cutlery when sharpening the cutlery. For this reason, the content of C is set to 0.45 to 0.55%. For achieving the above-described effect of C, the preferred lower limit of the content of C is 0.48% and the preferred upper limit of the content of C is 0.52%.

Si: 0.2 to 1.0%

Si is added as a deoxidizing agent during refinement. In order to obtain a sufficient deoxidizing effect, the residual amount of Si is 0.2% or more . On the other hand, if the content of Si exceeds 1.0%, the amount of inclusions is increased to cause a chip in the cutlery when sharpening the cutlery. Accordingly, the content of Si is set to 0.2 to 1.0%. The preferred lower limit of the content of Si is 0.40% and the preferred upper limit of the content of Si is 0.60%.

Mn: 0.2 to 1.0%

Mn is also added as a deoxidizing agent during refinement in the same manner as Si. In order to obtain a sufficient deoxidizing effect, the residual amount of Mn is 0.2% or more. On the other hand, if the content of Mn exceeds 1.0%, the hot workability is deteriorated. Accordingly, the content of Mn is set to 0.2 to 1.0%. The preferred lower limit of the content of Mn is 0.60% and the preferred upper limit of the content of Mn is 0.90%.

Cr: 12 to 14%

The reason why the content of Cr is set to 12 to 14% is to achieve sufficient corrosion resistance and also to suppress the crystallization of eutectic carbides during casting or solidification to the minimum. If the content of Cr is less than 12%, sufficient corrosion resistance as stainless steel cannot be obtained. On the other hand, if the content of Cr exceeds 14%, the amount of crystallized eutectic carbides is increased to cause a chip in the cutlery when sharpening the cutlery. For this reason, the content of Cr is set to 12 to 14%. For achieving the above-described effect of Cr, the preferred lower limit of the content of Cr is 13.2% and the preferred upper limit of the content of Cr is 14%.

Mo: 2.1 to 2.8%

The reason why the content of Mo is set to 2.1% or more is to decrease a tempered carbide ($M_3C$) and also to obtain an effect of miniaturizing the size of the tempered carbide. This is because Mo is one of the elements capable of forming a carbide of its own, and has properties that it is hardly dissolved in $M_3C$. In a tempering temperature range, $M_3C$ is generated due to the diffusion of only C. However, it is considered that when a specific amount of Mo is present in a base, Mo prevents $M_3C$ from aggregating or increasing its size (Mo miniaturizes $M_3C$).

As shown in the below-described Examples, when the content of Mo is set to 2.1%, almost no $M_3C$ having a size of 0.1 μm or more is observed, and therefore, the lower limit of the content of Mo is set to 2.1%. However, if the content of Mo exceeds 2.8%, deformation resistance is increased to deteriorate the hot workability, and therefore, the upper limit of the content of Mo is set to 2.8%. For this reason, the content of Mo is set to 2.1 to 2.8%. For achieving the above-described effect of Mo, the preferred lower limit of the content of Mo is 2.3% and the preferred upper limit of the content of Mo is 2.6%.

This $M_3C$ deposited by tempering has a higher hardness than a martensite matrix, and therefore, when bending stress is applied to cutlery, due to a difference in hardness between $M_3C$ and the martensite matrix, a crack is liable to occur at the boundary between $M_3C$ and a martensite matrix. $M_3C$ continues to be deposited in a grain or along a crystal grain boundary. In Particularly, $M_3c$ formed at the boundary is liable to be an origin from which the cracks form during the bending process, and it is considered that a decrease in the content of $M_3C$ at the boundary is advantageous to suppression of crack formation.

The balance other than the elements described above is made up of Fe and impurities.

Examples of representative impurity elements include P, S, Ni, V, Cu, Al, Ti, N, and O. These elements are unavoidably mixed therein, however, it is preferred to regulate the contents thereof within the following ranges as the ranges that do not impair the effects of the respective elements to be added in the present invention:

P≤0.03%, S≤0.005%, Ni≤0.15%, V≤0.2%, Cu≤5 0.1%, Al≤0.01%, Ti≤0.01%, N≤0.05%, and O≤0.05%.

Further, an effective thickness of the steel strip for cutlery of the invention excellent in the bending process is preferably 0.10 mm or less and particularly preferably 0.08 mm or less.

EXAMPLES

Hereinafter, the present invention will be described in more detail with reference to the following Examples.

Example 1

Steel ingots (materials) having chemical components shown in Table 1 were prepared by vacuum melting.

Each of the thus prepared steel ingots was extended by forging, and then, repeatedly subjected to annealing and cold rolling, whereby a steel strip for cutlery having a thickness of 0.074 mm was formed.

TABLE 1

(mass %)

| No. | C | Si | Mn | Cr | Mo | Balance | Remarks |
|---|---|---|---|---|---|---|---|
| A | 0.51 | 0.45 | 0.83 | 13.38 | 0.01 | Fe and unavoidable impurities | Comparative Example |
| B | 0.50 | 0.44 | 0.85 | 13.83 | 0.65 | Fe and unavoidable impurities | Comparative Example |
| C | 0.50 | 0.46 | 0.82 | 13.76 | 1.30 | Fe and unavoidable impurities | Comparative Example |
| D | 0.50 | 0.47 | 0.86 | 13.65 | 1.99 | Fe and unavoidable impurities | Comparative Example |
| E | 0.50 | 0.47 | 0.86 | 13.63 | 2.57 | Fe and unavoidable impurities | Present invention |

From each of the thus formed steel strips for cutlery, a test piece for observing the structure, a test piece for measuring the hardness, and a bending test piece were taken. Each test piece was subjected to a heat treatment under the conditions for a simulation of formation of cutlery. This heat treatment includes heating to 1100° C. for 40 seconds, quenching to room temperature, a cryogenic treatment at −75° C. for 30 minutes, and tempering at 350° C. for 30 minutes.

The results of the observation of the structure are shown in FIG. 1. Incidentally, the observation of the metal structure was performed as follows. After mirror-polishing the test piece for observing the structure, the test piece was corroded with an aqueous solution of ferric chloride, and then, the structure was observed using a scanning electron microscope.

Figure 2:
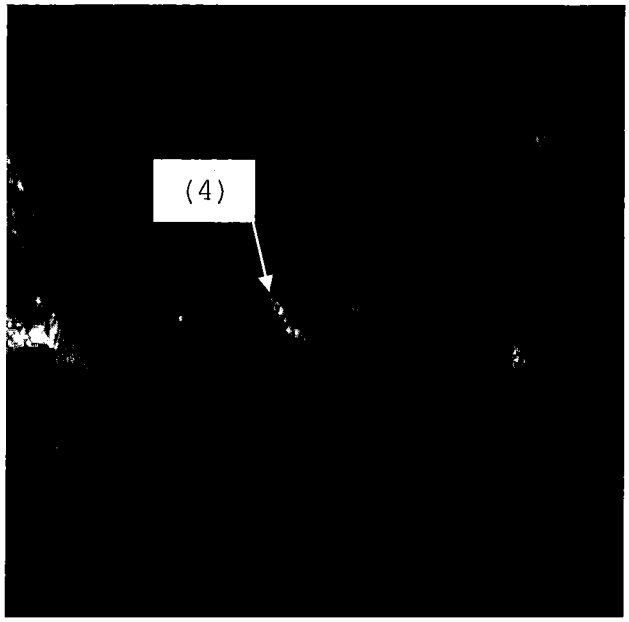
FIG. 2 is electron micrographs showing the $M_3C$.
Figure 2:
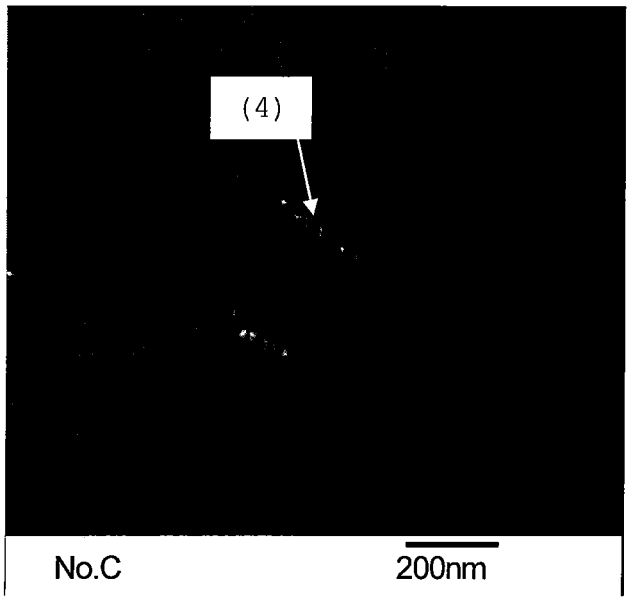

A carbide having a spherical shape or a size exceeding 0.2 μm seen in FIG. 1 is a primary carbide (1). In the case of the test piece of No. A in which the addition amount of Mo was 0.01%, white fine $M_3C$ was deposited. It is found that $M_3C$ was present in two states of a state of being finely dispersed in a crystal grain (2) and a state of being along a crystal grain boundary (3). Moreover, as the amount of Mo increased, the amount of $M_3C$ was decreased and the size thereof was somewhat miniaturized. $M_3C$ observed with a transmission electron microscope (TEM) is shown in FIG. 2. In dark-field images of the test pieces of Nos. A and C, carbides (4) found using a scanning electron microscope were observed, and the carbides were confirmed as $M_3C$ through diffraction patterns thereof. In the case of the test piece of No. E observed with the transmission electron microscope, $M_3C$ was not observed.

Subsequently, a test piece having a thickness of 0.074 mm, a length of 20 mm, and a width of 6 mm was prepared, and a 90° bending test was performed using the same device. The presence or absence of a crack was observed from directly above the bent portion using a scanning electron microscope, and the bendability was evaluated. The results are shown in FIG. 3.

Figure 3:
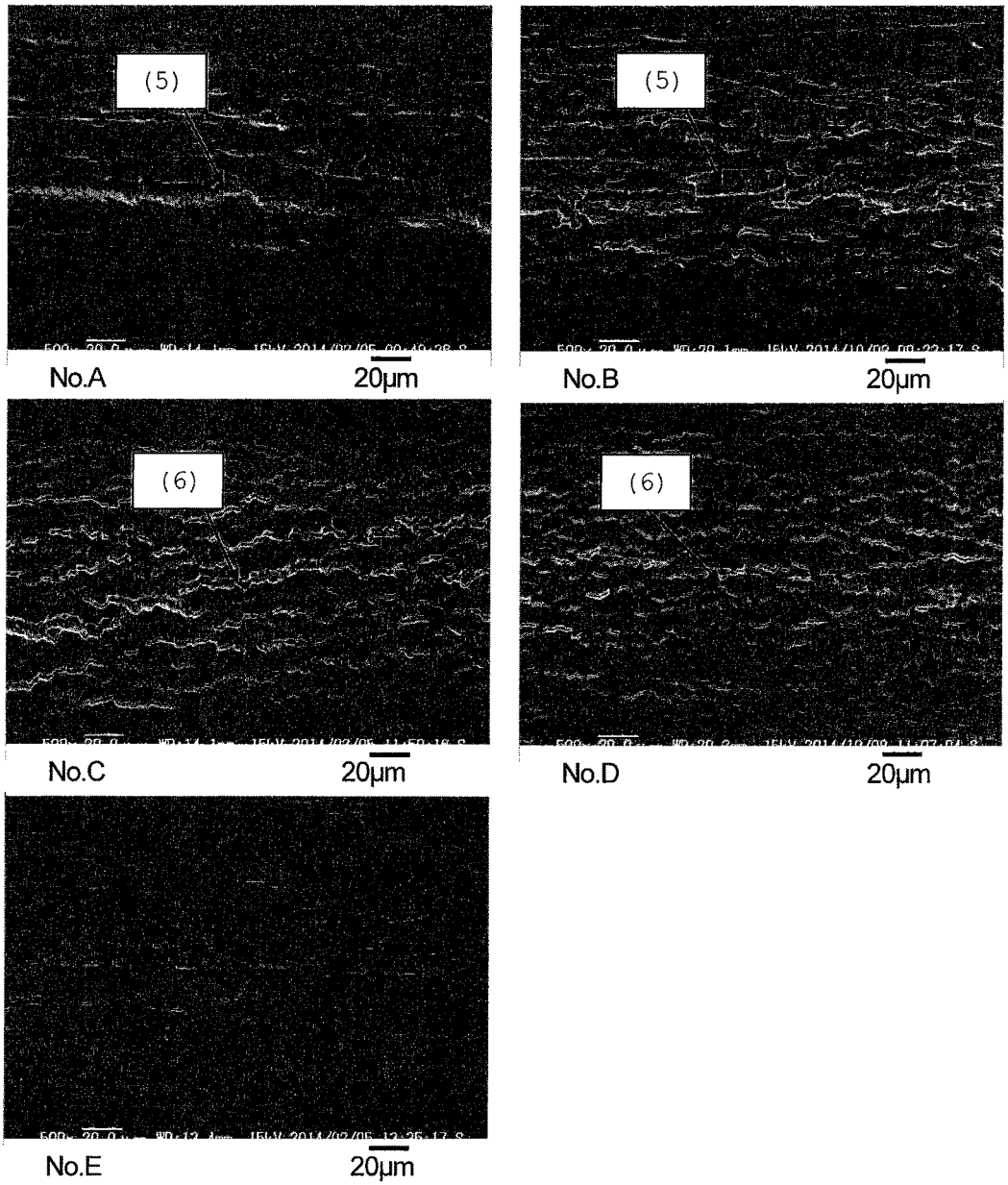
FIG. 3 is electron micrographs showing the surface of a steel strip for cutlery after a bending test.

From FIG. 3, the following observations can be drawn. In the case of the test pieces of No. A in which the addition amount of Mo was 0.01% and No. B in which the addition amount of Mo was 0.65%, large and deep cracks (5) were observed. In the case of the test piece of No. C in which the addition amount of Mo was 1.30%, it is found that cracks (6) were small and shallow. As the addition amount of Mo was increased, the cracks became shallower. In the case of the test piece of No. E (the present invention) in which the addition amount of Mo was set to 2.57%, it is found that no cracks were generated. In the cases of the test pieces of Nos. C and D in which microcracks were widely formed, the interval between formed cracks was about 10 μm. This was almost the same as the diameter of the crystal grain observed with SEM. From this, it is found that cracks were preferentially formed from $M_3C$ deposited along the grain boundary during the bending process. When the amount of Mo was increased, $M_3C$ at the grain boundary was decreased, thereby suppressing the formation of cracks.

Next, the results of the measurement of the hardness and a remaining austenite amount are shown in Table 2. The remaining austenite amount was measured as follows. The surface portion of a sample was subjected to mirror polishing, and further subjected to electrolytic polishing, and then X-ray diffraction was performed on the polished sample. In the X-ray diffraction, amount of a FCC phase was measured, using RINT2500 manufactured by Rigaku Corporation and using Co as a radiation source, from a diffracted X-ray intensity ratio obtained from each surface of (200)α, (211)α, (200)γ, (220)γ, and (311)γ under a condition of voltage of 40 kV and a electric current of 200 mA.

From Table 2, it is found that the test piece of No. E (the present invention) has a hardness of 635 HV, and a sufficient hardness as material of cutlery is obtained.

TABLE 2

| Material | Hardness (HV) | Remaining austenite amount (%) | Remarks |
|---|---|---|---|
| A | 587 | 6.1 | Comparative Example |
| B | 621 | 6.7 | Comparative Example |
| C | 610 | 6.3 | Comparative Example |
| D | 622 | 5.8 | Comparative Example |
| E | 635 | 6.3 | Present invention |

Example 2

Next, test was carried out using large-sized steel ingots.

A composition of the large-sized steel ingots is shown in Table 3.

Each of the prepared steel ingots was repeatedly subjected to hot rolling, annealing, and cold rolling, whereby a steel strip for cutlery having a thickness of 0.074 mm was formed.

TABLE 3

(mass %)

| No. | C | Si | Mn | Cr | Mo | Balance | Remarks |
|---|---|---|---|---|---|---|---|
| F | 0.49 | 0.48 | 0.89 | 13.47 | 1.25 | Fe and unavoidable impurities | Comparative Example |

TABLE 3-continued (mass %)

| No. | C | Si | Mn | Cr | Mo | Balance | Remarks |
|---|---|---|---|---|---|---|---|
| G | 0.50 | 0.45 | 0.87 | 13.62 | 2.31 | Fe and unavoidable impurities | Present invention |
| H | 0.50 | 0.46 | 0.87 | 13.57 | 2.61 | Fe and unavoidable impurities | Present invention |
| I | 0.49 | 0.46 | 0.88 | 13.58 | 2.89 | Fe and unavoidable impurities | Comparative Example |

From each of the thus formed steel strips for cutlery, a test piece for observing the structure and a test piece for measuring the hardness were taken. Each test piece was subjected to a heat treatment, and then a structure investigation and a hardness test were carried out. This heat treatment includes quenching to 1100° C. for 40 seconds, quenching to room temperature, a cryogenic treatment at −75° C. for 30 minutes, and tempering at 350° C. for 30 minutes.

Figure 4:
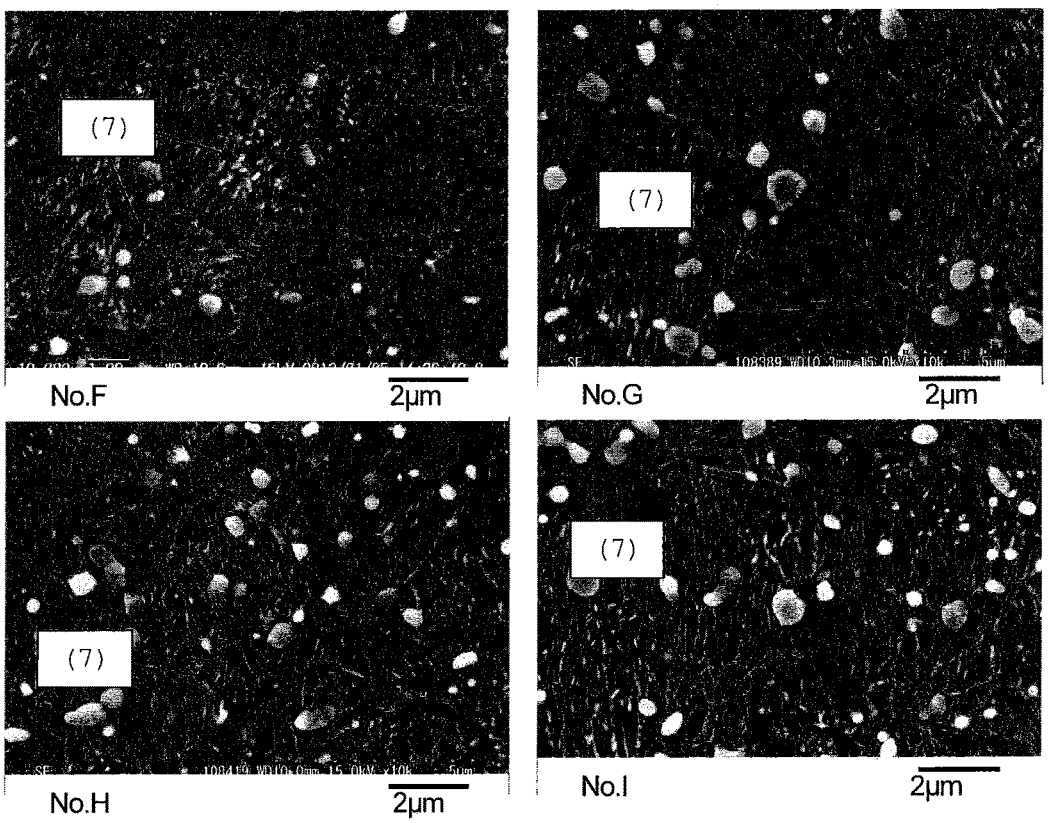
FIG. 4 is electron micrographs showing the metal structure of a steel strip for cutlery.

The results of the observation of the structure are shown in FIG. 4. Incidentally, the observation of the metal structure was performed as follows. After mirror-polishing the test piece for observing the structure, the test piece was corroded with an aqueous solution of ferric chloride, and then, the structure was observed using a scanning electron microscope.

In comparison with the case of the test piece of No. F in which the addition amount of Mo was 1.25%, in the cases of the test pieces of Nos. G, H, and I in which the addition amount of Mo was increased, $M_3C$ (7) was decreased and the size thereof was miniaturized.

Figure 5:
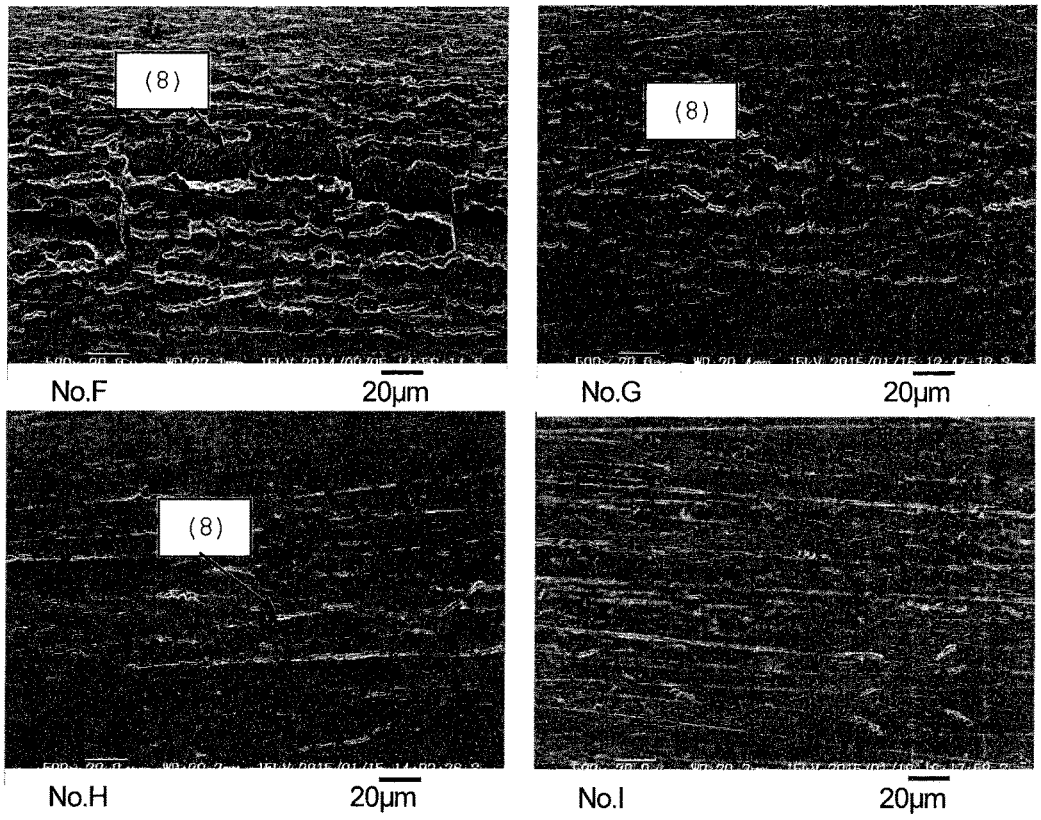
FIG. 5 is electron micrographs showing the surface of a steel strip for cutlery after a bending test.

Subsequently, a test piece having a thickness of 0.074 mm, a length of 20 mm, and a width of 6 mm was prepared, and a 90° bending test was performed using the same device. The results are shown in FIG. 5. It is found that as the amount of Mo increased, the formed cracks (8) were smaller and shallower. In the case of the test piece of No. F in which the addition amount of Mo was 1.25%, large and deep cracks were observed. However, In the case of the test piece of No. G in which the addition amount of Mo was 2.31%, cracks were small and shallow. Moreover, it is found that as the amount of Mo increased, cracks were shallower.

Next, the results of the measurement of the hardness are shown in Table 4. From Table 4, it is found that test piece according to the invention has a hardness of 630 HV or more, and a sufficient hardness as material of cutlery is obtained.

TABLE 4

| Material | Hardness (HV) | Remarks |
|---|---|---|
| F | 607 | Comparative Example |
| G | 632 | Present invention |
| H | 637 | Present invention |
| I | 653 | Comparative Example |

From the above results, in the steel strip for cutlery of the invention, it was confirmed that the formation of cracks is suppressed during the bending process while maintaining a sufficient hardness as cutlery.

INDUSTRIAL APPLICABILITY cutlery produced by using a steel strip for cutlery of the present invention has a sufficient hardness, but is hardly cracked by bending, and therefore, it can be expected to improve the workability. In particularly, the steel strip is most suitable as a steel strip for cutlery having a thin plate thickness.

Having thus described certain embodiments of the present invention, it is to be understood that the invention defined by the appended claims is not to be limited by particular details set forth in the above description as many apparent variations thereof are possible without departing from the spirit or scope thereof as hereinafter claimed.

What is claimed is:

1. A martensitic stainless steel strip for cutlery, which has a composition consisting of, in mass %, 0.45 to 0.55% of C, 0.2 to 1.0% of Si, 0.2 to 1.0% of Mn, and 12 to 14% of Cr, and 2.57 to 2.8% of Mo, with the balance made up of Fe and unavoidable impurities, wherein the martensitic stainless steel is quenched and tempered, and, in a martensite matrix, any tempered carbides having a size of at least 0.1 μm are not present.

2. The martensitic stainless steel strip for cutlery according to claim 1, wherein the unavoidable impurities consist essentially of the following elements within the following ranges: P≤0.03%, S≤0.005%, Ni≤0.15%, V≤0.2%, Cu≤0.1%, Al≤0.01%, Ti≤0.01%, N≤0.05%, or O≤0.05%.

3. The martensitic stainless steel strip for cutlery according to claim 1, wherein the steel strip is a cold rolled steel strip.

4. The martensitic stainless steel strip for cutlery according to claim 1, wherein the steel strip has a hardness of 630 HV or more in a state after quenching and tempering.

* * * * *